United States Patent [19]

Job

[11] 4,098,203

[45] Jul. 4, 1978

[54] ADVANCING OF A TEXTILE CLOTH ON AN EMBROIDERY MACHINE

[75] Inventor: Pierre Job, Lessines, Belgium

[73] Assignee: Waron Belgium S.A., Lessines, Belgium

[21] Appl. No.: 754,239

[22] Filed: Dec. 27, 1976

[30] Foreign Application Priority Data

Dec. 29, 1975 [BE] Belgium ..... 645313

[51] Int. Cl.[2] ..... D05C 9/08

[52] U.S. Cl. ..... 112/90

[58] Field of Search ..... 112/86, 90, 83, 79 R, 112/79 A

[56] References Cited

U.S. PATENT DOCUMENTS

| | | | |
|---|---|---|---|
| 2,528,392 | 10/1950 | Self | 112/79 R |
| 3,109,395 | 11/1963 | Batty et al. | 112/79 R |
| 3,183,866 | 5/1965 | Walbert et al. | 112/90 |
| 3,380,414 | 4/1968 | Gray | 112/79 R |
| 3,396,687 | 8/1968 | Nowicki | 112/79 A |
| 3,585,948 | 6/1971 | Cobble | 112/79 R |
| 3,842,767 | 10/1974 | Short | 112/79 R |

FOREIGN PATENT DOCUMENTS

| | | | |
|---|---|---|---|
| 2,130,689 | 1/1973 | Fed. Rep. of Germany | 112/90 |
| 2,413,523 | 10/1974 | Fed. Rep. of Germany | 112/79 R |

*Primary Examiner*—Alfred R. Guest
*Attorney, Agent, or Firm*—Martin A. Farber

[57] ABSTRACT

A device for advancing a textile cloth, for instance on an embroidery loom, in accordance with which the cloth unwinds forward without limit, with possible return to the rear, while continuously retaining the same predetermined tension due to the direct action of an electromagnetic coupler, which by electronically controlled tensions and relaxations of tension, balances the advance and rearward-return process of the cloth.

4 Claims, 2 Drawing Figures

Figures 1, 2:
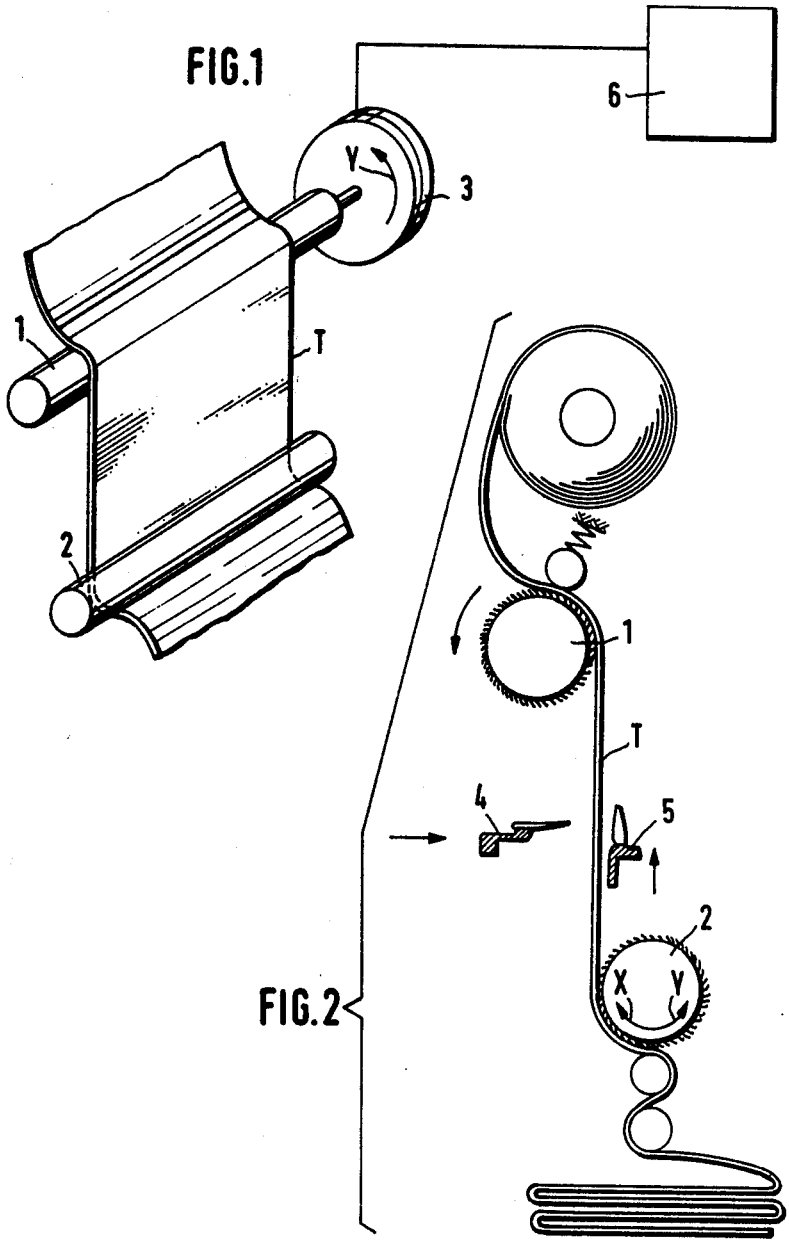

6
Y
3
1
T
2
1
T
4
5
2
X
Y

ADVANCING OF A TEXTILE CLOTH ON AN EMBROIDERY MACHINE

The present invention relates to the advancing of a textile cloth, particularly on an embroidery machine, but also on a tufting machine or any other machine employing cloth as base support.

In embroidery machines, for instance, a vertical frame is employed on which a cloth is stretched. By means of an automatic mechanism, this frame moves along the resultant of a vertical movement and a horizontal movement. After each displacement of the frame, a group of needles located on one side of the cloth passes through the cloth and encounters a group of shuttles located on the other side. The sequence of these various movements causes the progression of the frame in accordance with a design which the automatic device programs. At a given moment, the frame is at the end of its stroke, that is to say at its high point. It is then necessary to release the cloth and unroll it while manually returning the frame to its point of origin, and finally to tension the cloth again.

With this system registration of the design is difficult to effect and presents textile defects, which makes numerous manual repairs necessary.

In order to remedy the system which has been known and used up to the present time, it was found advantageous to eliminate this vertical frame and to provide, in a textile machine employing a cloth under tension, a device for advancing the cloth which is characterized by the fact that the cloth unwinds in limitless manner in the forward direction, with a rearward return possible, while continuously maintaining the same predetermined tension.

In accordance with the invention, the cloth retains the same tension due to the action of an electromagnetic coupler which, by electronically controlled tensionings and slackenings, balances out the forward and rearward return operations of the cloth. The attaching and detaching of the cloth are effected with cylinders covered with card clothing.

One object of the invention is to associate with the above advancing device a synchronized horizontal displacement of the banks of needles and shuttles, while avoiding lateral displacement of the cloth for the production or non-production of a design.

In order that the invention may be better understood, it will now be described in further detail with reference to the accompanying diagrammatic drawing, given solely by way of example, in which:

FIG. 1 is a perspective view of the various parts constituting the advancing device of the invention, and FIG. 2 is a vertical section through the device of FIG. 1.

The advancing device for a textile cloth T in accordance with the invention, as shown in the drawing, comprises two cylinders 1, 2 covered with card clothing the orientation of the teeth of which permits the suitable attachment and detachment of the cloth. These cylinders move the cloth in vertical movements in both directions without allowing it to relax.

The cylinder 2 is driven directly by the automatic control device and, depending on the programmed pattern imparts movements in both directions (directions X and Y in FIG. 2).

The cylinder 1 maintains the cloth T under tension at all times, due to an electromagnetic coupler 3 which turns with a continuous sliding movement in the direction Y.

A bank of needles 4 and shuttles 5 moves alternatively to the left and to the right, at all times in coordination with their initial stitching movement.

Upon each movement of the cylinder 2 in the direction X the cylinder 1 takes up the displacement of the cloth while maintaining it taut.

Upon each movement in the direction Y, the cylinder 2 takes up the displacement without stress due to a relaxation of tension of the cylinder 1.

The adjustments, relaxations, and variations in tension of the cloth are obtained by the use of electronic switches 6 which control the electromagnetic coupler 3.

The apparatus in accordance with the invention can be placed in any positional angle while retaining its effectiveness and output. It can be used for the advancing of cloth of any width, 14 meters and more. It can also be used for all types of winding, unwinding, or displacement of semi-finished products such as ribbons, threads, and sheets.

One of the advantages of the invention is that it provides continuous designs without stopping the machine and without registration of patterns. The travel of the cloth may be endless.

Of course, changes which fall within the scope of the attached claims can be made in the advancing device described above and shown in the accompanying drawing without thereby going beyond the scope of the invention.

I claim:

1. A device for advancing of a textile cloth, for instance on an embroidery loom, comprising means for unwinding a cloth in a forward direction without limitation, with possible rearward-return, while continuously retaining the same predetermined tension, an electromagnetic coupler means directly operatively connected with said unwinding means for retaining the same tension on the cloth and by electronically controlled tensions and relaxations for balancing out the advance and rearward-return of the cloth.

2. The advancing device according to claim 1, wherein said unwinding means includes cylinder means with card clothing for effecting attachment and detachment of the cloth, respectively.

3. The advancing device according to claim 1, wherein said unwinding means comprises, a pulling cylinder, a drive cylinder spaced parallel to said pulling cylinder, said electromagnetic coupler is mounted on said pulling cylinder, electronic means for synchronising said electromagnetic coupler with said drive cylinder, and a stand-by memory.

4. The advancing device according to claim 1, further comprising banks of needles and shuttles synchronized for horizontal displacement avoiding lateral displacement of the cloth.

* * * * *